US010399760B2

(12) United States Patent
Rhyu et al.

(10) Patent No.: US 10,399,760 B2
(45) Date of Patent: Sep. 3, 2019

(54) COMPLEX PACKAGING CONTAINER FOR INSTANT FOOD

(71) Applicant: CJ CHEILJEDANG CORPORATION, Seoul (KR)

(72) Inventors: Ki Min Rhyu, Seoul (KR); Kyoung Sik Cho, Seoul (KR); Hui Jae Song, Seoul (KR); Gyu Hwan Cha, Seoul (KR)

(73) Assignee: CJ CHEILJEDANG CORPORATION, Seoul (KR)

( * ) Notice: Subject to any disclaimer, the term of this patent is extended or adjusted under 35 U.S.C. 154(b) by 0 days.

(21) Appl. No.: 15/099,747

(22) Filed: Apr. 15, 2016

(65) Prior Publication Data

US 2016/0318690 A1 Nov. 3, 2016

(30) Foreign Application Priority Data

Apr. 29, 2015 (KR) ..... 20-2015-0002783 U
Jan. 22, 2016 (KR) ..... 20-2016-0000395 U

(51) Int. Cl.
*B65D 43/02* (2006.01)
*B65D 21/02* (2006.01)
(Continued)

(52) U.S. Cl.
CPC ..... *B65D 81/3216* (2013.01); *B65D 81/3453* (2013.01); *B65D 81/3205* (2013.01)

(58) Field of Classification Search
CPC ..... B65D 81/3216; B65D 81/3453; B65D 85/816; B65D 2543/00296;
(Continued)

(56) References Cited

U.S. PATENT DOCUMENTS 2,094,257 A * 9/1937 Luck ..... B65D 1/34 220/23.89
2,287,610 A * 6/1942 Guidry ..... B65D 3/24 206/568
(Continued)

FOREIGN PATENT DOCUMENTS

KR 20-0256210 Y1 12/2001
KR 20-0431743 Y1 11/2006
(Continued)

OTHER PUBLICATIONS

Disclosures—CJ Chieljedang (with English translations) (14 pages) (Apr. 16, 2015-Apr. 17, 2015).
(Continued)

*Primary Examiner* — J. Gregory Pickett
*Assistant Examiner* — Gideon R Weinerth
(74) *Attorney, Agent, or Firm* — Seed IP Law Group LLP

(57) ABSTRACT

The present invention relates a complex packaging container for an instant food. The complex packaging container includes: an outer container; an inner container accommodated in the outer container while being spaced apart from the outer container by a predetermined interval; and a main container that covers an opening formed in the inner container. Accordingly, instant foods can be stably packaged in one packaging container to be distributed, and the packaging container can be conveniently opened to be taken by the user.

6 Claims, 7 Drawing Sheets

(51) Int. Cl.
*A47G 19/00* (2006.01)
*B65D 81/32* (2006.01)
*B65D 81/34* (2006.01)

(58) Field of Classification Search
CPC ..... B65D 21/0233; B65D 81/3205; B65D 81/3876; B65D 2543/00731; B65D 2543/00537; A47J 47/14; A47J 47/02
USPC ..... 220/23.89, 505, 737, 23.87, 23.83, 4.27; 426/106, 103, 120, 119; 229/125.05, 229/120.32; 215/227
See application file for complete search history.

(56) References Cited

U.S. PATENT DOCUMENTS 2,591,578 A * 4/1952 McNealy ..... B65D 3/22 229/103.11
3,070,275 A * 12/1962 Bostrom ..... B65D 51/28 220/500
3,287,140 A * 11/1966 Brussell ..... A47J 36/022 126/262
3,349,941 A * 10/1967 Wanderer ..... B65D 43/021 206/514
3,445,050 A * 5/1969 Friehe ..... B65D 43/022 220/23.88
3,552,634 A * 1/1971 Ollier ..... B65D 51/185 215/232
4,018,904 A * 4/1977 Muraoka ..... B65D 11/16 206/217
4,091,953 A * 5/1978 Daenen ..... A47J 47/02 220/23.86
4,094,996 A * 6/1978 Sakakibara ..... A23P 20/20 426/115
4,340,138 A * 7/1982 Bernhardt ..... B65D 51/18 206/216
4,348,421 A * 9/1982 Sakakibara ..... A47J 47/14 206/217
4,697,703 A * 10/1987 Will ..... A61F 2/0095 206/363
5,129,517 A * 7/1992 Hustad ..... B65D 43/021 206/1.5
5,472,542 A * 12/1995 Wermund ..... B65D 43/021 156/245
5,787,839 A * 8/1998 Magnant ..... A01K 5/0114 119/51.5
7,832,586 B2 * 11/2010 Vovan ..... B65D 1/34 220/23.89
8,613,249 B2 * 12/2013 France ..... B65D 81/34 220/23.87
8,871,285 B2 * 10/2014 Markoulis ..... A47J 31/401 206/219
2004/0058038 A1 * 3/2004 Lee ..... A47J 47/14 426/107
2004/0188450 A1 * 9/2004 Marshall ..... B29C 44/0407 220/737
2005/0051549 A1 * 3/2005 Nelson ..... B65D 21/0219 220/23.83
2007/0000922 A1 * 1/2007 Vovan ..... B65D 51/24 220/4.27
2007/0138192 A1 * 6/2007 Send ..... B65D 41/18 220/780
2007/0227919 A1 * 10/2007 True ..... B65D 81/3216 206/219
2009/0297673 A1 * 12/2009 Sebban ..... B65D 81/3453 426/107
2010/0015293 A1 * 1/2010 Shapiro ..... B65D 1/34 426/87
2011/0006069 A1 * 1/2011 Fields ..... A47J 47/02 220/575
2012/0138608 A1 * 6/2012 Rusnak ..... B65D 43/0208 220/23.87
2013/0008897 A1 * 1/2013 Rusnak ..... B65D 43/0231 220/23.89
2014/0263352 A1 * 9/2014 Yang ..... B65D 81/3216 220/523
2015/0166241 A1 * 6/2015 Huffman ..... B65D 81/3453 426/120
2015/0239612 A1 * 8/2015 Wang ..... B65D 81/3216 220/23.89
2016/0009465 A1 * 1/2016 Pan ..... B65D 51/28 220/212
2016/0122080 A1 * 5/2016 Blatstein ..... B65D 21/0228 220/500
2016/0318690 A1 * 11/2016 Rhyu ..... B65D 81/3453

FOREIGN PATENT DOCUMENTS

KR 10-2011-0033340 A 3/2011
KR 20-0475771 Y1 12/2014

OTHER PUBLICATIONS

Kim Heyon-dong, Promotion Department, CJ Cheiljedang (with English translation), (3 pages) e-mail dated Apr. 16, 2015.

* cited by examiner

【 FIG. 1 】
100
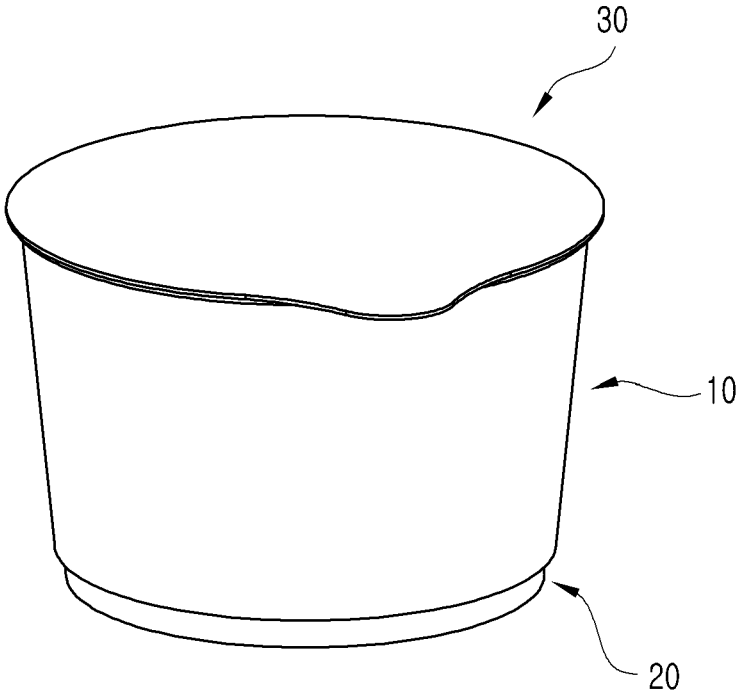

【 FIG. 2 】
100
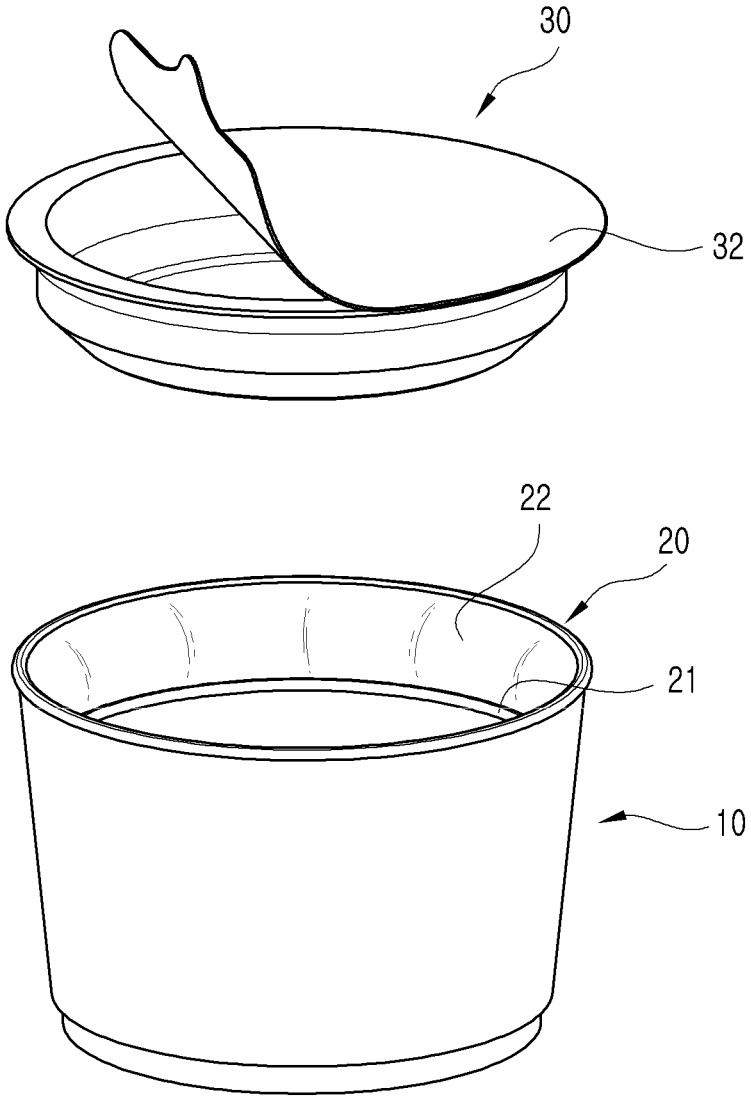

【 FIG. 3 】
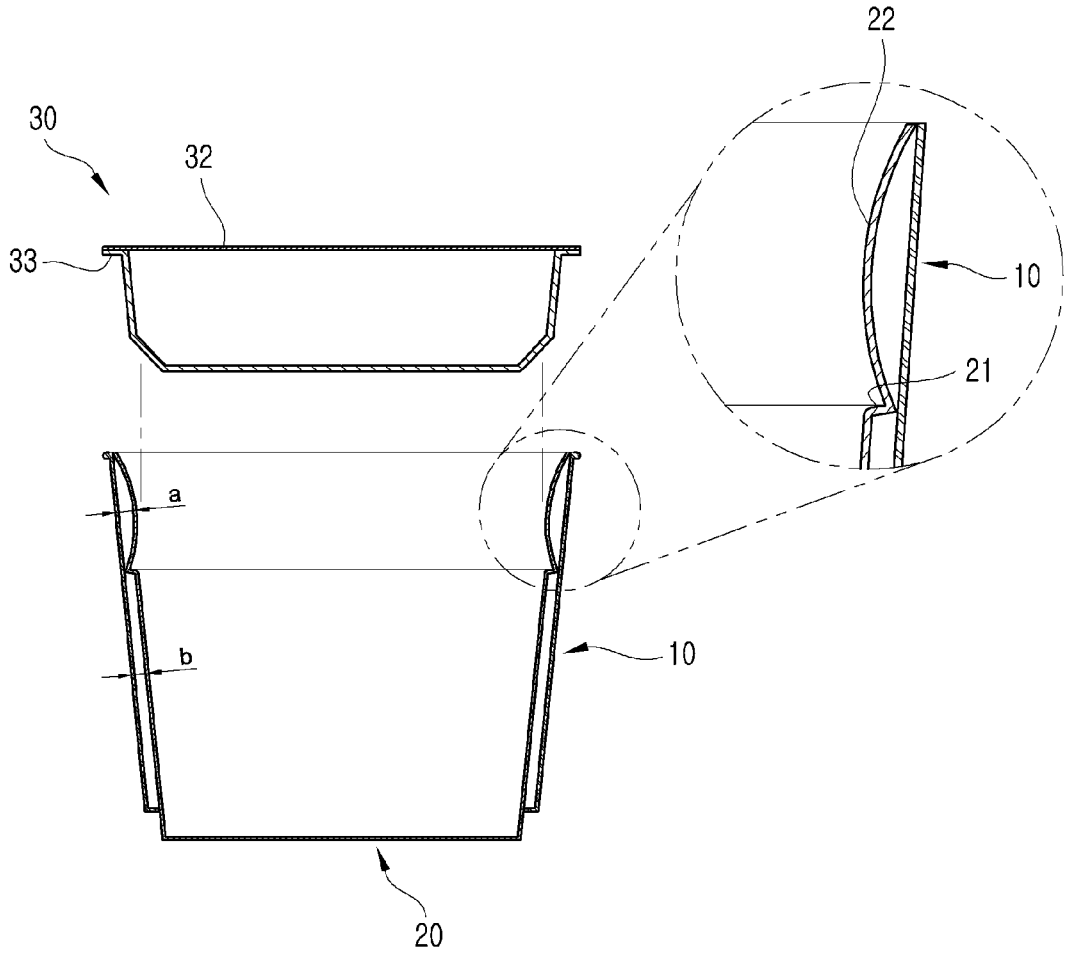

【 FIG. 4 】
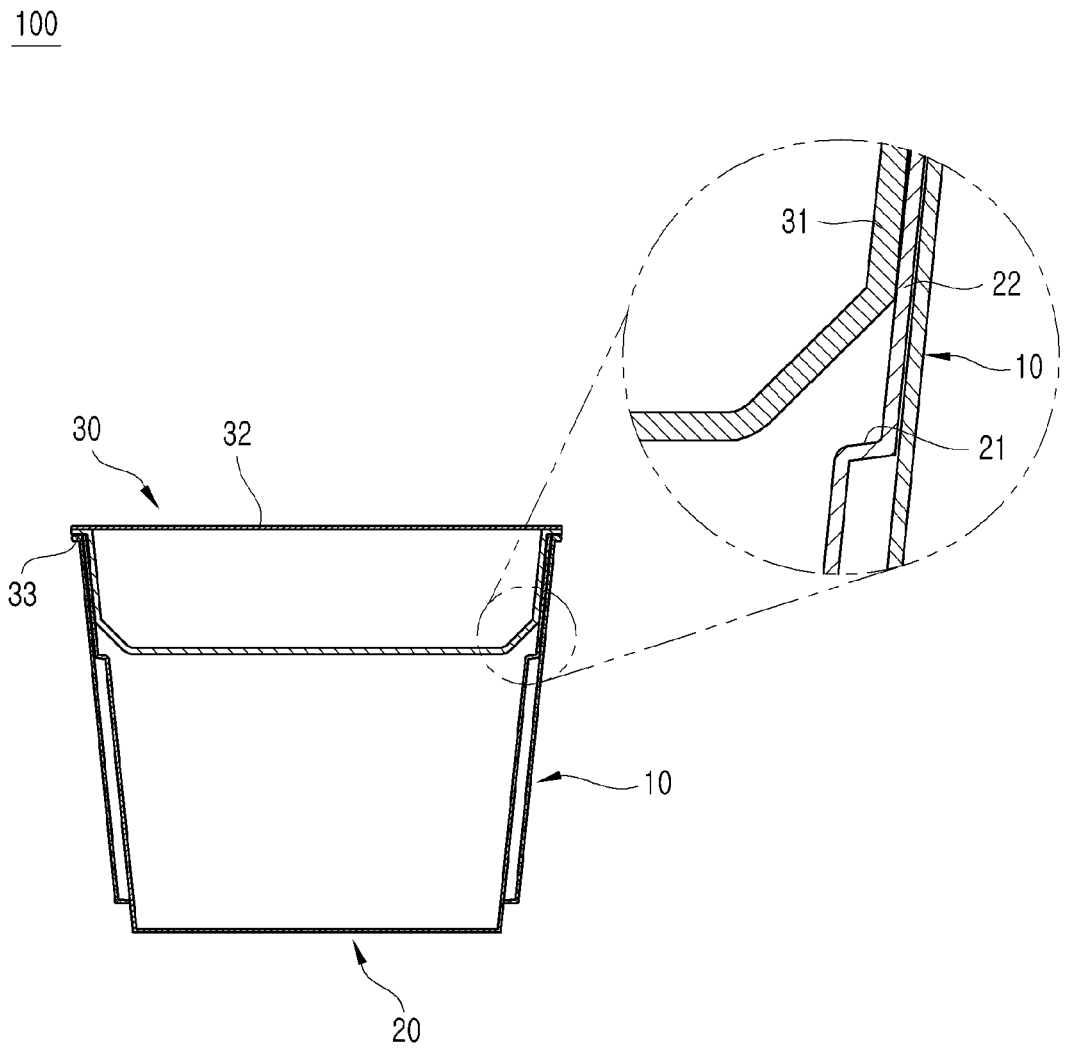

【 FIG. 5A 】
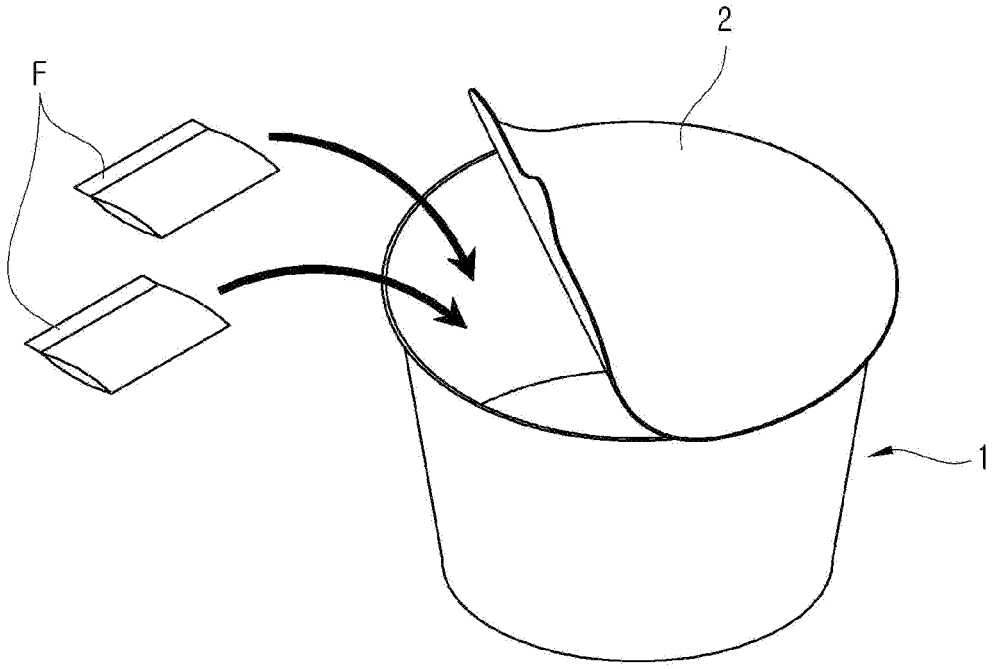
Prior Art

【 FIG. 5B 】
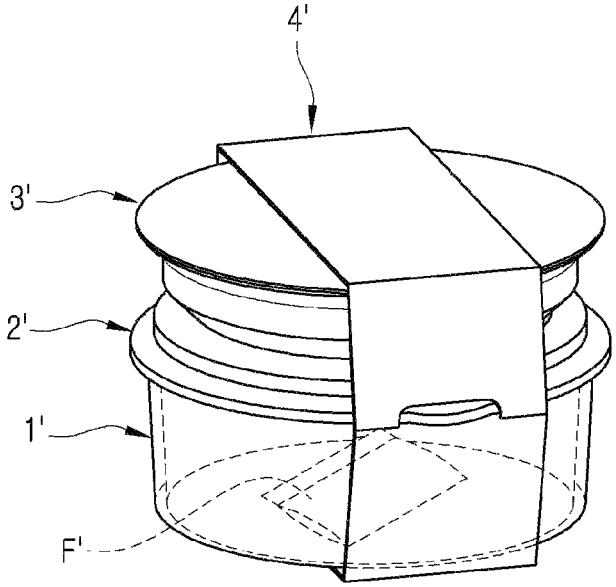
Prior Art

【 FIG. 5C 】
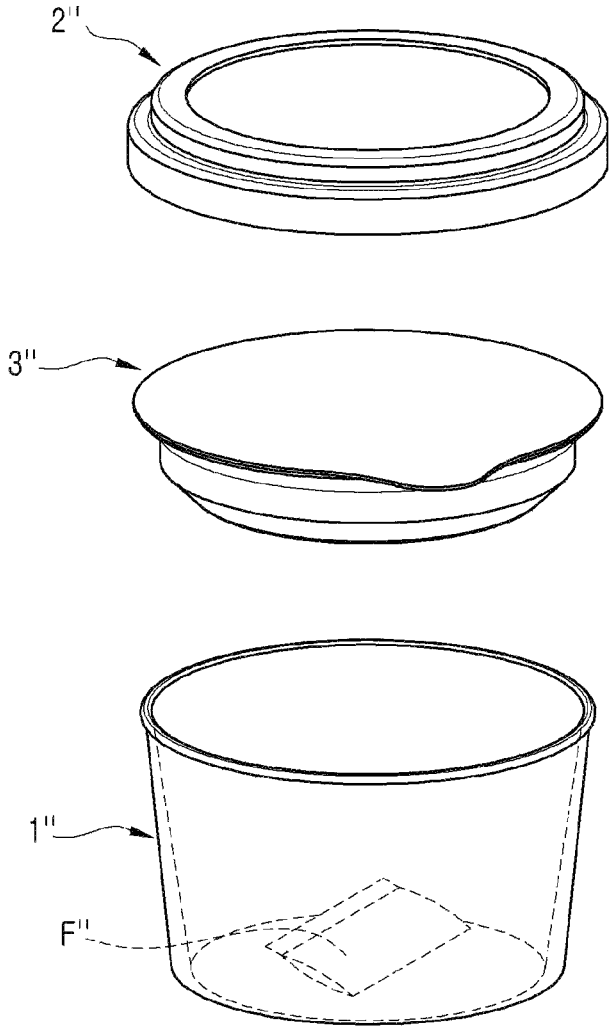
Prior Art

COMPLEX PACKAGING CONTAINER FOR INSTANT FOOD

TECHNICAL FIELD

The present invention relates to a complex packaging container for an instant food, and more particularly, a packaging container that allows the consumer to conveniently open the packaging container to take the contents, by putting instant rice and processed foods that may be taken together with the rice into a single packaging container and distributing the packaging container.

BACKGROUND ART

Due to the expansion of single-person households and the popularization of convenience store foods, the demand for processed foods that allow the consumers to conveniently substitute a meal has been increasing. Further, unlike the foreign countries where one meal is taken with a main food, Koreans can feel satisfactory only if rice, soup, and side dishes are served together due to the Korean dinner style. In addition, due to the distribution characteristics, ambient-temperature distribution products that may be kept relatively easily as compared with cold chains can improve the convenience of the consumers. The eco-friendly property of the packaging members also is an important item in aspects of recent packaging.

Containers have been developed to satisfy the above needs of the consumers. The forms of the containers largely include cups, instant rice, subsidiary foods contained in source pouches, and shrink films.

As illustrated in FIG. 5A, an existing container for complex instant foods is configured such that the uppermost end of a cup container 1 is covered by a cap 2 such that the contents are not popped out of the cup container 1 after instant rice (not illustrated) and other subsidiary foods F are put into the cup container 1, and a container for cup ramen or other complex instant foods also is configured such that the contents (noodles, soup, and the like) are put into the cup container and a contraction covers the outermost part of the container after the upper end of the cup container is sealed by a lead film.

Accordingly, the consumers have to remove a cap, a contraction film, a lead film and the like in stages, and the use of the unnecessary packaging members increases manufacturing costs and wastes.

Meanwhile, a packaging container as illustrated in FIG. 5B is known as a container that packages instant rice or another main food 3' and other subsidiary foods F' together. The packaging container is configured such that the subsidiary foods F' are accommodated in the cup container 1', a cap 2' covers an opening at an upper end of the cup container 1', the main food 3' is disposed on the cap 2', and the cup container 2' and the main food 3' are packaged by using a separate packaging member 4' while being disposed one on another.

The packaging container may package the main food 3' and the subsidiary foods F' at once, but the cap 2' that covers the cup container 1' and the packaging member 4' are necessary.

Further, as illustrated in FIG. 5C, a container in which all of a main food 3" and subsidiary foods F" are accommodated in the cup container 1" and an upper end of the cup container 1" is covered by a cap 2" such that the main food 3" is not separated is known. The packaging of the container is simple because the main food 3' and the subsidiary foods F' are accommodated in the cup container 1", but a film that encloses the cap 2" covers the upper end of the cup container 1" and the whole container is still necessary.

The packaging containers can package complex foods, but manufacturing costs and wastes still increase due to the inconvenience of removing a lead film or a cap by the consumers and use of unnecessary packaging members.

PRIOR TECHNICAL DOCUMENTS

Patent Documents (Patent document 1) KR 2011-0033340 A

DISCLOSURE

Technical Problem

The present invention has been made in an effort to solve the above-mentioned problems, and provides a complex packaging container for an instant food that packages separate instant foods in a single packaging container and then distribute the packaging container, allowing the consumer to conveniently take the foods.

Technical Solution

According to an embodiment of the present invention, there is provided a complex packaging container for an instant food, including: an outer container; an inner container accommodated in the outer container while being spaced apart from the outer container by a predetermined interval; and a main container that covers an opening formed in the inner container.

It is preferable that the complex packaging container further includes a coupling part situated on one side of an upper circumference of the inner container.

It is preferable that the coupling part protrudes towards the inside of the inner container by a predetermined distance.

It is preferable that the coupling part has a resilient force to provide a coupling force between the main container and the inner container.

It is preferable that the outer container and the inner container are integrally formed.

It is preferable that one side of the outer container is opened such that a portion of the inner container is exposed while the inner container is accommodated in the outer container.

It is preferable that the complex packaging container further includes a stopping part that extends outwards along an outer periphery of the main container, and the main container is situated such that the stopping part is laid over an outer periphery of the inner container.

Advantageous Effect

According to the complex packaging container for an instant food of the present invention, various instant foods can be stably packaged in one container to be distributed, and the container can be conveniently opened so that the consumer can take the foods.

BRIEF DESCRIPTION OF THE DRAWINGS

FIG. 1 is a perspective view of a complex packaging container for an instant food according to an embodiment of the present invention;

FIG. 2 is an exploded perspective view of the complex packaging container for an instant food according to the embodiment of the present invention;

FIG. 3 is a longitudinal sectional view of the complex packaging container for an instant food according to the embodiment of the present invention, and illustrates a state before a main container 30 is coupled;

FIG. 4 is a longitudinal sectional view of the complex packaging container for an instant food according to the embodiment of the present invention, and illustrates a state in which the main container 30 is coupled; and FIG. 5A to 5C illustrate a conventional packaging container.

BEST MODE

The objects, features, and other advantages of the present invention will be more apparent through description of the preferred embodiment of the present invention with reference to the accompanying drawings. It should be noted that the drawings are not to precise scale and may be exaggerated in thickness of lines or size of components for descriptive convenience and clarity. In addition, terms used herein are defined by taking functions of the present invention into account and can be changed according to user or operator custom or intention. Therefore, definition of the terms should be made according to the overall disclosure set forth herein.

Further, the described embodiment is exemplary for describing the present invention, and does not limit the technical scope of the present invention.

The elements of the complex packaging container according to the present invention may be integrally used or may be separately used according to occasions. Furthermore, some of the elements may be omitted according to the usage formed of the present invention.

Hereinafter, a complex packaging container 100 for an instant food (hereinafter, simply referred to as "a packaging container 100) for convenience of description) according to an embodiment of the present invention will be described in detail with reference to FIGS. 1 to 4.

The packaging container 100 according to the embodiment of the present invention may include an outer container 10, an inner container 20, and a main container 30.

The outer container 10 may has a column shape or an inverse-cone shape with an interior space, and as illustrated in FIGS. 1 and 2, may has a cylindrical or inverse-cone shape but the shape of the outer container 10 is not be limited thereto, and the outer container 10 may have a polygonal column shape such as a rectangular column or rectangular inverse-cone shape and it will good as long as the interior of the outer container 10 is hollow.

The inner container 20 is accommodated in the outer container 10, and also has an interior space such that the contents (for example, instant soup) of an instant food may be accommodated in the interior space. It is preferable that the inner container 20 has a shape corresponding to the outer container 10 to be accommodated in the outer container 10 but the present invention is not limited thereto, and as illustrated in FIGS. 2 and 3, a lower surface of the outer container 10 may be opened such that a lower portion of the inner container 20 is exposed while the inner container 20 is accommodated in the outer container 10.

Further, as illustrated in FIGS. 3 and 4, it is preferable that the outer peripheral surface of the inner container 20 is spaced apart from the inner peripheral surface of the outer container 10 by a predetermined interval b while the inner container 20 is accommodated in the interior of the outer container 10. The instant food is generally taken by opening a package of the contents, containing the contents into a container corresponding to the inner container 20, pouring hot water into the container or heating the container with a microwave oven, and in this case, an interval is present between the outer container 10 and the inner container 20 such that an insulating effect is obtained so that the container containing the hot contents can be effectively touched by the user or a danger of a burn that may occur while the container is raised can be effectively prevented.

The interval b between the outer container 10 and the inner container 20 may be provided by forming a stepped portion 21 obtained by stepping an inner peripheral portion of the inner container 20 inwards.

As illustrated in FIG. 2, it is preferable that the stepped portion 21 is formed such that an entire circumference of the inner peripheral surface of the inner container 20 protrudes.

It is preferable that the main container 30 includes a container part 31 having a space for accommodating the contents of the instant food therein and the container part 31 has a shape corresponding to the shape of the inner container 20, but the present invention is not limited thereto. The contents accommodated in the interior of the container part 31 of the main container 30 preferably may be contents (for example, instant rice) that are different from contents accommodated in the interior of the inner container 20, and an upper side of the container part 31 may be covered by a cover 32 including a film such that the contents is accommodated in the container part 31 and then packaged.

In this way, the contents accommodated in the inner container 20 and the contents accommodated in the main container 30 may be mixed to be conveniently taken.

Further, at least a portion of the main container 30 may be accommodated in and fixed to the inner container 20 to seal the inner container 20. Accordingly, the main container 30 may function as a cover that seals the inner container 20 while being accommodated in the inner container 20, and accordingly, the contents can be effectively accommodated and packaged without using the cover of a film or the like. Further, while in the case of a conventional packaging container 100 that finally packages a cup container with a lead film, the lead film is removed first, a portion of the cover is removed again, a film cover is fixed so as not to be opened or an object is positioned on the packaging container to fix the packaging container 100 so that hot air is not exhausted or the contents are not spattered when hot water is poured into the container or the contents are heated by a microwave oven in order that the user may take the contents, according to the present invention, only the main container 30 may be removed, the contents are moved into the inner container 20, and the empty main container 30 is coupled to the inner container 20 again to cover the inner container 20 so that the user may conveniently use the packaging container 100.

In order that the main container 30 may perform the function of the cover that seals an opening of the inner container 20 more effectively in this way, the diameter of the main container 30 may be at least the same or slightly larger than the diameter of the inner container 20. In this way, because the diameter of the main container 30 is the same as or slightly larger than the diameter of the inner container 20 and the main container 30 is interference-fitted with an opening at an upper end of the inner container 20, the sealing effect is effectively guaranteed.

Further, the packaging container 100 according to the present invention may further include a coupling part 22 configured such that an upper end of the inner container 20, that is, an inner peripheral portion of the inner container 20, with which the main container 30 is fitted and coupled, protrudes to the inside of the inner container 20 while being spaced apart from the outer container 10 by a predetermined interval a, and a higher coupling force and a higher sealing effect are guaranteed due to the protruding shape of the coupling part 22. Further, preferably, the coupling part 22 may have a resiliency. Accordingly, because the coupling part 22 is pushed towards the outer container 10 by a pressing force of the main container 30 when the main container 30 is coupled, the main container 30 can be coupled to the inner container 20 more easily and a stronger coupling force and a higher sealing effect can be guaranteed by allowing the coupling part 22 to press a side wall of the main container 30 by using resiliency after the main container is coupled to the inner container 20.

Additionally, because the main container 30 includes a stopping part 33 that extends outwards along an outer periphery of the container part 31, the stopping part 33 is laid over an outer periphery of an upper end of the inner container 20 when the main container 30 is coupled to the inner container 20 so that the main container 30 may be stably coupled.

Although the preferred embodiment of the present invention has been described until now, the present invention is not limited to the aforementioned specific embodiment.

For example, although it has been exemplified that the inner container 10 and the outer container 20 are separately provided such that one is separated from and accommodated in the other in the aforementioned embodiment, it is apparent that the outer container 10 and the inner container 20 may be integrally formed.

Although the preferred embodiments of the present invention have been described, it will be understood by those skilled in the art that the present invention can be variously corrected and modified without departing from the spirit and scope of the present invention claimed in the claims.

DESCRIPTION OF REFERENCE NUMERALS

100: complex packaging container for instant food
10: outer container
20: inner container
22: coupling part
30: main container
32: cover
33: stopping part

The invention claimed is:

1. A complex packaging container for an instant food, comprising:

an outer container;

an inner container accommodated in the outer container while being spaced apart from the outer container by a predetermined interval, the inner container having a stepped portion and a coupling part situated on one side of an upper circumference of the inner container;

a main container that covers an opening formed in the inner container, the main container being above the stepped portion and being coupled to the inner container by the coupling part pressing a middle portion of a side wall of the main container, the main container comprising:

an unperforated container part; and a stopping part that extends outward along an outer periphery of the main container, a first side of the stopping part being in contact with an outer periphery of the inner container; and a cover attached to a second side of the stopping part and sealing the unperforated container part, the second side being opposite the first side, wherein the main container is configured to be detached from the inner container while the cover is attached to the main container.

2. The complex packaging container of claim 1, wherein the coupling part protrudes towards the inside of the inner container by a predetermined distance.

3. The complex packaging container of claim 1, wherein the outer container and the inner container are integrally formed.

4. The complex packaging container of claim 1, wherein one side of the outer container is open such that a portion of the inner container is exposed while the inner container is accommodated in the outer container.

5. The complex packaging container of claim 1, wherein the main container is received in the inner container so that from outside to inside the outer container, the inner container, and the main container are sequentially disposed, thereby resulting in a three layered wall.

6. A complex packaging container for an instant food, comprising:

an outer container;

an inner container accommodated in the outer container while being spaced apart from the outer container by a predetermined interval, the inner container having a stepped portion;

a main container that covers an opening formed in the inner container, the main container being above the stepped portion and comprising:

an unperforated container part; and a stopping part that extends outward along an outer periphery of the main container, a first side of the stopping part being in contact with an outer periphery of the inner container; and a cover attached to a second side of the stopping part and sealing the unperforated container part, the second side being opposite the first side, wherein the main container is configured to be detached from the inner container while the cover is attached to the main container, wherein a lower surface of the outer container is open such that a lower portion of the inner container is exposed while the inner container is accommodated in the outer container.

* * * * *